US006704429B2

(12) United States Patent
Lin

(10) Patent No.: US 6,704,429 B2
(45) Date of Patent: Mar. 9, 2004

(54) EARPHONE WITHOUT IMPULSE NOISE AND SURROUNDINGS BLOCKADE

(76) Inventor: Chung Yu Lin, 29, Tunnel 152, Kuang Hwa 1 Rd., Kaohsiung (TW)

( * ) Notice: Subject to any disclaimer, the term of this patent is extended or adjusted under 35 U.S.C. 154(b) by 25 days.

(21) Appl. No.: 10/011,530

(22) Filed: Nov. 5, 2001

(65) Prior Publication Data

US 2002/0080990 A1 Jun. 27, 2002

Related U.S. Application Data

(63) Continuation-in-part of application No. 09/345,135, filed on Jul. 6, 1999.

(51) Int. Cl.[7] ..... H04R 25/00

(52) U.S. Cl. ..... 381/380; 379/430; 381/371; 381/373; 381/370; 381/332; 181/130; 181/135

(58) Field of Search ..... 381/380, 370, 381/371, 322, 374, 372, 373, 151, 173; 181/129, 128, 135, 132, 20, 22, 149, 130, 179; 379/430; 455/568, 349

(56) References Cited

U.S. PATENT DOCUMENTS 2,293,078 A * 8/1942 Proctor
4,646,872 A * 3/1987 Kamon et al.
4,736,435 A * 4/1988 Yokoyama et al.

* cited by examiner

*Primary Examiner*—Curtis Kuntz
*Assistant Examiner*—Dionne Harvey
(74) *Attorney, Agent, or Firm*—Raymond Y. Chan; David and Raymond Patent Group

(57) ABSTRACT

An earplug type earphone without impulse noise and surroundings blockade includes an earphone housing having a sound chamber inside thereof and a loudspeaker mounted therein, wherein a plurality of sound outlet meshes is provided on the front end of the earphone housing. A proper distance is given between the front end of the earphone housing and the loudspeaker mounted therein. A plurality of sound inlet meshes is provided on and encircled the earphone housing within the proper distance. The lower impulse noise output end with respect to two output ends of the loudspeaker is arranged to face to the sound outlet meshes. Therefore, the earphone can prevent not only the impulse noise directly impact to the middle ear but also the damage of the middle ear and the cause of conductive hearing loss.

9 Claims, 7 Drawing Sheets

EARPHONE WITHOUT IMPULSE NOISE AND SURROUNDINGS BLOCKADE

CROSS REFERENCE OF RELATED APPLICATION

This is a Continuation-In-Part application of a non-provisional application having an application number of Ser. No. 09/345,135 and a filing date of Jul. 6, 1999.

BACKGROUND OF THE PRESENT INVENTION

1. Field of Invention

The present invention relates to an earphone, and more particularly to an earphone without impulse noise surroundings blockade, wherein the sound outside can be caught by the human ear so that any events outside are able to be realized at once without taking off the earphone. Moreover, the present invention can also prevent conductive hearing loss caused by the direct impact of the impulse noise.

2. Description of Related Arts

An ordinary earphone, referring FIGS. 1 to 3B of the drawings, comprises a earphone housing 10, a loudspeaker 20, and a sound outlet cover 30, wherein the earphone housing 10 comprising a sound chamber 11 and an open-end 12. The loudspeaker 20 is mounted on the sound chamber 11 of the earphone housing 10. The sound outlet cover 30 is affixed on the open-end 12 of the earphone housing 10, wherein a plurality of sound outlet meshes 31 is formed on the surface of the sound outlet cover 30. The impulse noise output end 21 of the loudspeaker 20 is faced to the sound outlet meshes 31 of the sound outlet cover 30. When the earphone is hanged between a tragus A1 and an antitragus A2 of the human ear A (as shown in FIG. 1), sound emitted from the impulse noise output end 21 of the loudspeaker 20 transmits through the sound outlet meshes into the ear canal A3 of the human ear A. As shown in FIG. 3B, it is apparent that the sound wave impacts directly on the eardrum and the ear canal A3 is totally obstructed by the earphone.

Form the above, it is realized that when people are using the ordinary earphone 10, the sound emitted by the loudspeaker 20 will all transmit through the meshes 31 of the sound outlet cover 30 to the human ear A. The sound from outside cannot pass through the earphone housing 10 and cannot combine the sound emitted by the loudspeaker 20 together and then transmit to the human ear A. So, when people wear the ordinary earphone 10, they can only hear the sound from the loudspeaker 20 and will completely be blocked hearing and knowing from outside because, as shown in FIG. 3B, the speaker 20 itself blocks the ear canal A3 that may danger their lives especially while they are driving or walking on the street.

Furthermore, in 1997, UT Southwestern Medical Center stated: "approximate 20% of American Teenagers, between 13-19 have hearing disability. The major cause of the hearing loss is that people exposed to the noise especially the impulse noise from the earphone." People should concern the control of the sound volume while using the traditional earphone (continuous hearing not more than one hour or six hours per day when sound pressure at 105 dB or 95 dB respectively). In fact, this flash impulse noise contains high sound pressure and may damage the eardrum or middle ear hearing loss. It is called Conductive Hearing Loss. America's medical report recently stated that the percentage of people having the Conductive Hearing Loss is gradually increasing since the earplug type earphones are improperly used listen to the hot music such as Rock and Roll.

In other words, sound emitted by an ordinary earphone contains impulse noise. When an ordinary earplug type earphone is used, the impulse noise will directly impact to the external auditory canal A3 of the human ear A and make people feel uncomfortable. The continuous use of an ordinary earplug type earphone will result in damage of the middle ear and the cause of hearing loss to the people.

U.S. Pat. No. 4,736,435, Yokoyama et al suggests a plurality of through-openings which are required to be provided on the back portion of the outer casing, which may be small as possible and can not be enlarged larger than a predetermined size because they are used to avoid the sound characteristic be deteriorated. However, the loudspeaker thereof is installed in the front end of the housing that itself blocks the ear canal so that even sound from outside may enter the earphone through the through openings on the back portion thereof but the sound from outside is also blocked by the loudspeaker and the user has no way to listen anything from outside, as shown in FIG. 6 of the drawings.

U.S. Pat. No. 5,949,896, Nageno, merely discloses an earcup type headphone that contains through holes to enable sound from outside to enter the box body. However, earcup type headphone is absolutely different to earplug type earphone because that the earplug type earphone has a relative small size and is adapted to be inserted into the entrance of the ear canal.

Moreover, both the '435 and '896 patents are constructed to directly inlet the high impulse noise emitted from the loudspeaker into the ear canal A3 of the human ear A, as indicated in FIGS. 1 to 3 that may cause the impulse noise directly impacting to the external auditory canal A3 of the human ear A and make people feel uncomfortable. Like all the conventional earphone or headphone, the continuous use of the '435 and '896 patents may result in damage of the middle ear and the cause of hearing loss to the people. Practically, such problems are remained unsolved in both the '435 and '896 patents.

In addition, in the past 20 years, so much progress has been achieved in designing and arranging the audio speaker system, such as "Dolby Surround Sound", "Dts 5.1" channel and home theater. But there are very few changes have been made in the acoustic field of the earplug type earphone.

In conclusion, there are numerous of disadvantages of the ordinary earphone that need to be solved as follows:

1. Cause hearing discomfort and eardrum injury if use them intensively.

No matter how advanced techniques have become in the past 20 years, the basic structure of earphones always has a speaker directly against the ear canal and eardrum.

The powerful sound wave keeps pounding on the delicate and fragile eardrum within the short and limited chamber of the ear canal—it is just like a fried cracker exploding in a tightly grasped hand! They symptom of itch or pain in the ear canal will be detected after lengthy use, which is an indication of eardrum injury.

2. Threaten safety when use them as a portable hands-free while driving or having outdoor activities.

Safety is the most imperative concern in communication, this is why we need hands-free to eliminate the risk of radiation jeopardy as well as maintain traffic safety while driving. But the traditional hands-free headset has the following insufficiencies:

i) It blocks the wearing ear. From the medical point of view, only when both ears hear sound simultaneously can a person identify the direction of it. Otherwise they cannot tell which direction it comes from. That is very dangerous while driving or having outdoor activities.

ii) It causes the imbalance of both ears thereby dizziness after long tie usage. That is dangerous as well.

iii) Because of the discomfort of most of the earphones (either too large or awkward in shape), people usually take them on and of frequently and only wearing them when they get phone calls. This will cause a fatal risk while driving.

3. Cause inconvenience when use them for stereo listening while working or talking to your friends.

Do you ever ask, "Why can't I privately listen to fabulous music and talk with friends simultaneously? Why can't I listen favorite songs privately at eh beach, while hearing the singing seagulls and the gentle paddling of sea waves at the seashore?" Nearly all traditional earphones are designed with such a purpose as to totally isolate the exterior environment.

4. Not feasible for communication because they enforce low and high frequency noise and decrease sound clarity.

The length of an adult's ear canal is about 2.4 cm. From the physical point of view, when both ends of the canal are obstructed, it is good to reproduce the frequency at around 6000 Hz (the length is about twice of the canal length) and lower than 500 Hz (the canal length is far shorter than this wave length). But it is bad to reproduce the frequency around 3000 Hz (the canal length is quarter of the wave length). Currently, traditional earphone design happens to obstruct both ends of the ear canal, creating just the same phenomena as mentioned above. Nevertheless current communication devices entail good 3000 Hz response (the very point that consonants exist) yet suppress the response under 500 Hz and over 5000 Hz (the site that low and high frequency noises exist). This is the current earphone weakpoint.

5. Fail to produce a spatial effect without the aid of electronic devices.

"Space is the mother of music". No matter how good the home theater system we have, if we attach our ear against a high-end speaker (tweeter), what we can hear is just a low-end flat sound. With the traditional earphones there is less chance to gain the originally recorded spatial effect.

6. Restricted in the design of shape and size.

Most traditional earphones are designed such to put the speakers, wearing part inside the ear. So the wearing part sometimes is too big, causing discomfort or too small being easily dropped from the ear. As the size and shape of the wearing part is restricted, thus ignores other groups of users such as women and children.

SUMMARY OF THE PRESENT INVENTION

The main object of the present invention is to provide an earplug type earphone without impulse noise and surroundings blockade, wherein the earphone is constructed to enable sound from outside passing through the earphone housing and combining with the sound emitted by the loudspeaker before transmitting into the ear canal of the human ear. While the present invention is used to listen to the music, people are still able to hear the sound from outside and realize the events outside to keep away from dangerous. The present invention substantially overcomes the disadvantages of the ordinary earplug type earphone which completely blocks hearing from outside.

Another object of the present invention is to provide an earplug type earphone without impulse noise and surroundings blockade, wherein sound emitted by the present invention does not contain any impulse noise. When the earphone is used to listen music, the present invention can prevent not only the impulse noise from directly impact to the middle ear but also the damage of the middle ear and the cause of hearing loss.

DETAILED DESCRIPTION OF THE PREFERRED EMBODIMENT

Figure 1:
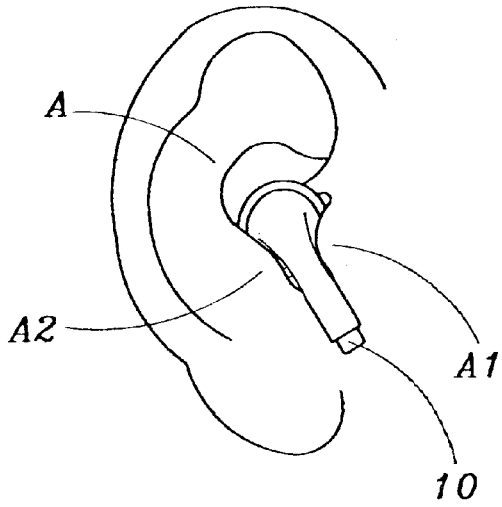
FIG. 1 PRIOR ART
FIG. 1 is a perspective view of the ordinary earphone hanged on the human ear.
Figure 2:
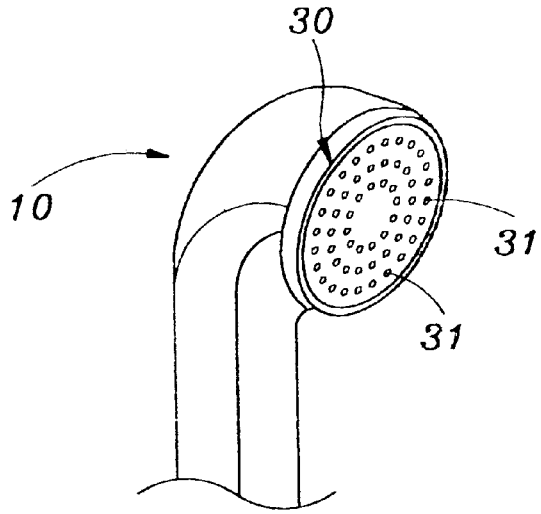
FIG. 2 PRIOR ART
FIG. 2 is a perspective view of the ordinary earphone.
Figure 3A:
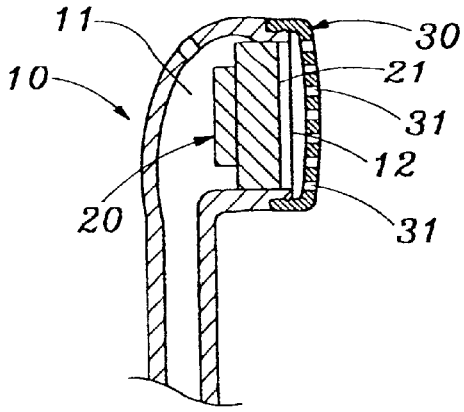
FIG. 3A PRIOR ART
FIG. 3A is a cross-sectional view of the ordinary earphone.
Figure 4:
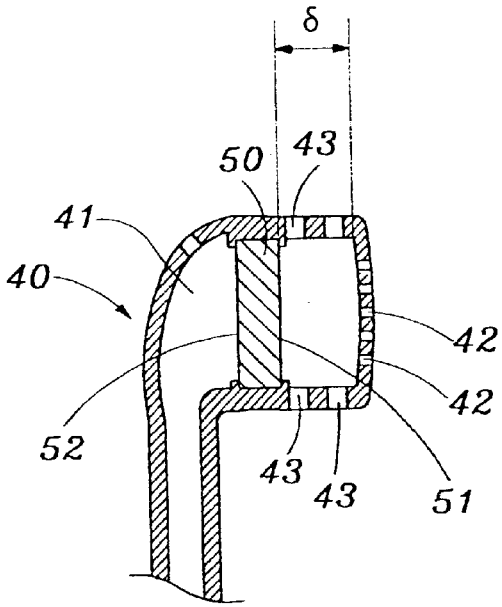
FIG. 4 is a cross-sectional view of an earphone-speaker according to a preferred embodiment of the present invention.
Figure 3B:
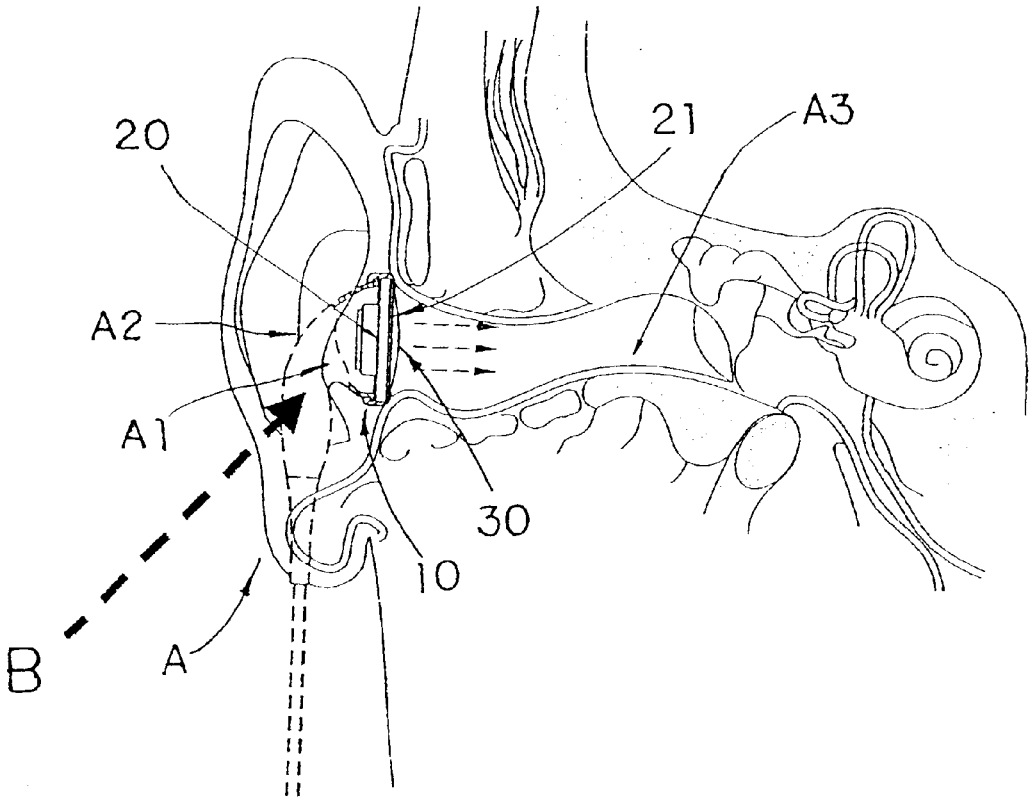
FIG 3B PRIOR ART
FIG. 3B is a cross-sectional view of the ordinary earphone hanged on the human ear.

Referring to FIG. 4 of the drawing, an earplug type earphone without impulse noise and surroundings blockade in accordance with the present invention comprises an earphone housing 40 having a sound chamber 41 inside thereof and a loudspeaker 50 mounted therein, wherein a plurality of sound outlet meshes 42 is provided on the front end of the earphone housing 40. A proper distance δ is given between the front end of the earphone housing 40 and the loudspeaker 50 mounted therein, wherein a plurality of sound inlet meshes 43 is provided on and encircled the earphone housing 40 within the proper distance δ. The loudspeaker 50 has an original impulse noise output end 52 and a back end 51 which is a relative lower impulse noise output end with respect to the two output ends 51, 52 of the loudspeaker 50. The lower impulse noise output end 51, i.e. the back end of the loudspeaker 50, is mounted to face to the sound outlet meshes 42 on the front end of the earphone housing 40.

Figure 5:
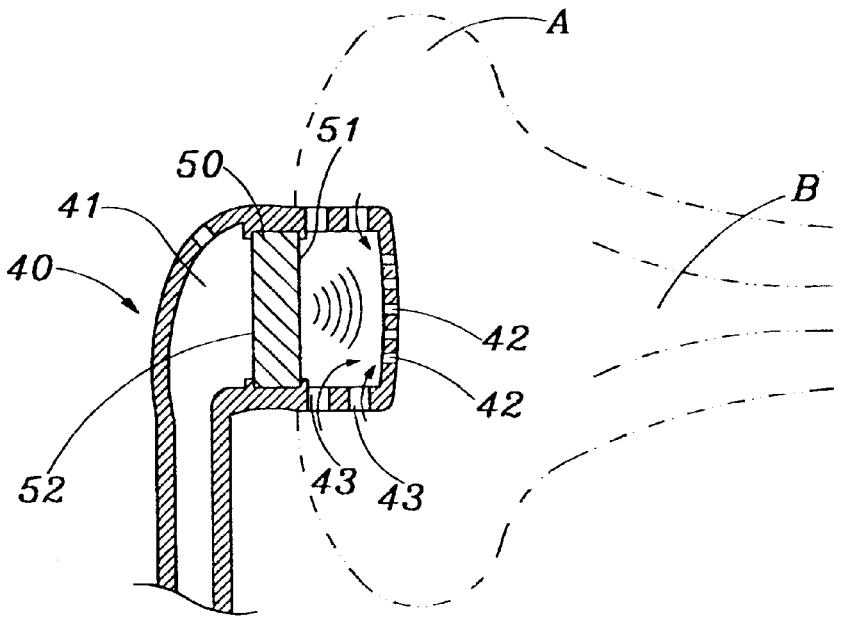
FIG. 5 is of a cross-sectional view of the earphone-speaker hanged on a human ear according to the above preferred embodiment the present invention.

Referring to FIG. 5, when the present invention is used, the front end of the earphone housing 40 is adapted for hanging fitly between a tragus and an antitragus of human ear A. When the earphone is used to listen music, sound from outside can also pass through the sound inlet meshes 43 into the earphone housing 40. The sound from outside then combines with the sound emitted by the loudspeaker 50 together and transmit to the external auditory canal B of the human ear A. So, the user can not only listen to the music produced by the loudspeaker 50 but also realize the events outside on the alert. Moreover, since the lower impulse noise output end 51 with respect to the two output ends 51, 52 of the loudspeaker 50 is faced to the sound outlet meshes 42 on the front end of the loudspeaker 50, the sound, which combined with the surroundings and the loudspeaker 50, transmitted to the external auditory canal B do not contain high impulse noise. That is, the unpleasant feeling made by the impact of the impulse noise will not happen to the people who love to use earplug type earphone for a long period of time and the sound will not cause conductive hearing loss and damage the middle ear as well.

Figure 6:
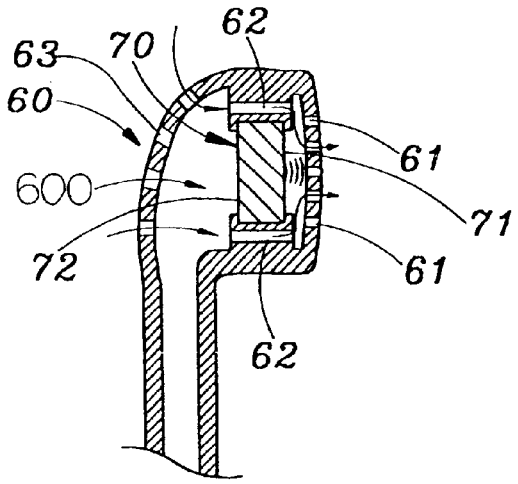
FIG. 6 is a cross-sectional view of the housing a first alternative mode of the above preferred embodiment of the present invention.

Referring to FIG. 6, a first alternative mode of the earplug type earphone without impulse noise and surroundings blockade according to the above preferred embodiment of the present invention is illustrated, which comprises an earphone housing 60 having a sound chamber 600 inside thereof and a loudspeaker 70 mounted in the sound chamber 600, wherein a plurality of sound outlet meshes 61 is provided on the front end of the earphone housing 60, a plurality of hollow meshes 62 is provided on the inner surface of the sound chamber 600 of the earphone housing 60 where the loudspeaker 70 mounted therein. The loudspeaker 70 also has an original output end 72 and a back end 71 which is a lower impulse noise output end 71 with respect to the output end 72 of the loudspeaker 70. The lower impulse noise output end 71 is arranged to face to the sound outlet meshes 61. A plurality of sound inlet meshes 63 is provided on a top portion and the surface of a rear end portion of the earphone housing 60. So, sound from outside can pass through the sound inlet meshes 63 into the earphone housing 60 and transmit through the hollow meshes 62 and the sound outlet meshes 61 into the human external ear. People are able to receive the sound outside and realize the events outside at once without taking off the earphone. In other words, merely sound with low impulse noise emitted from the lower impulse noise output end 71 of the loudspeaker 70 will enter the user's ear canal that will not give any unpleasant feeling for people and avoid the damage of the human middle ear and the cause of hearing loss.

Figure 7:
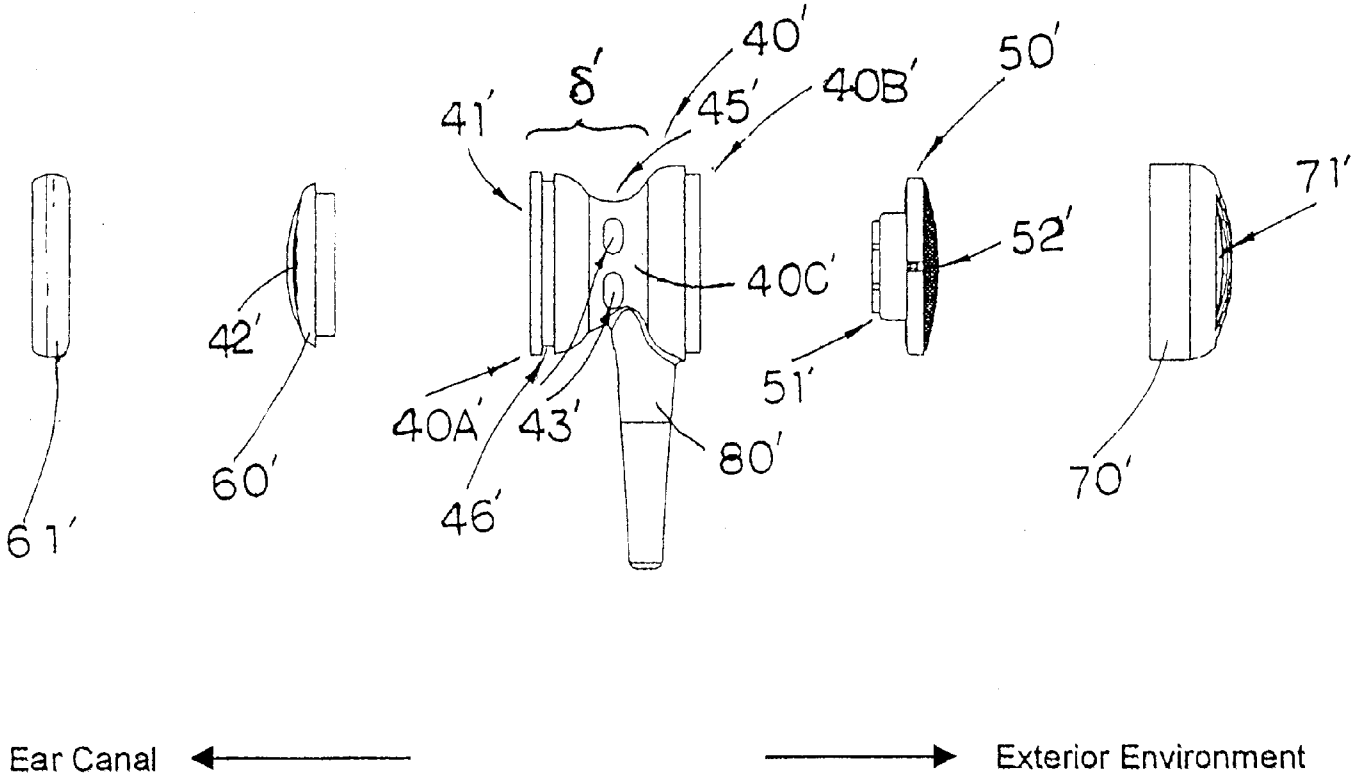
FIG. 7 is an exploded elevation view of an earphone-speaker according to a second alternative mode of the above preferred embodiment of the present invention.
Figure 8:
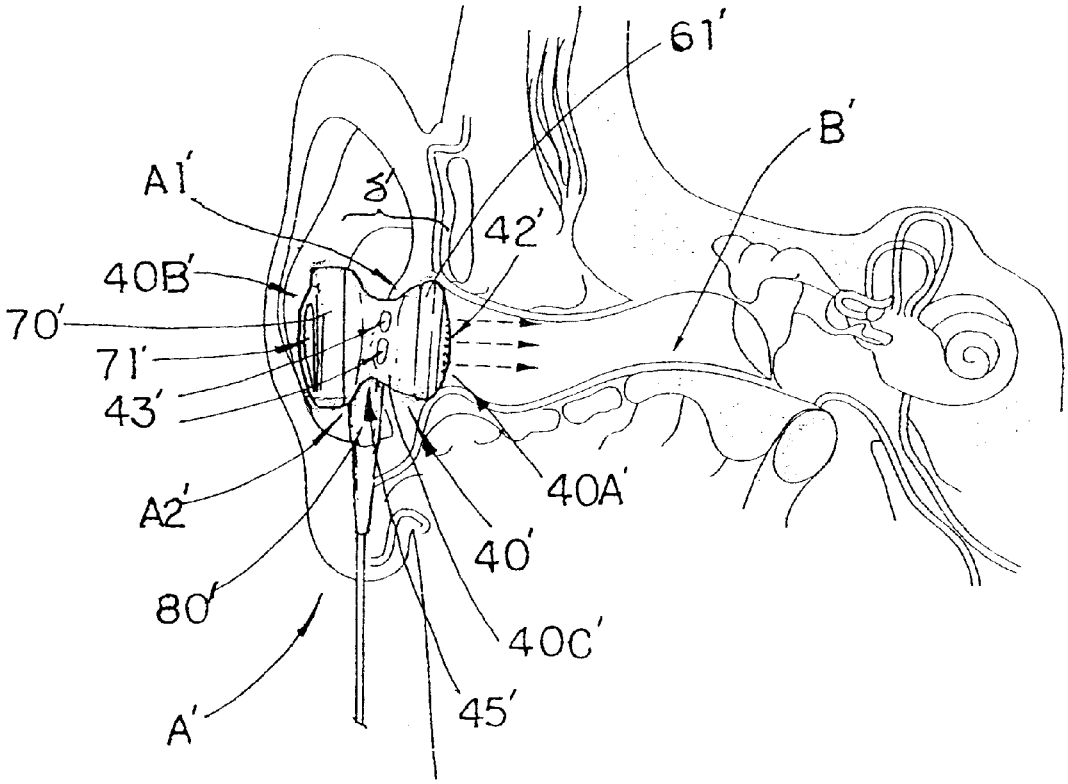
FIG. 8 is a schematic view illustrating how the earphone-speaker hanged on the human ear according to the above second alternative mode of the above preferred embodiment of the present invention.
Figure 9:
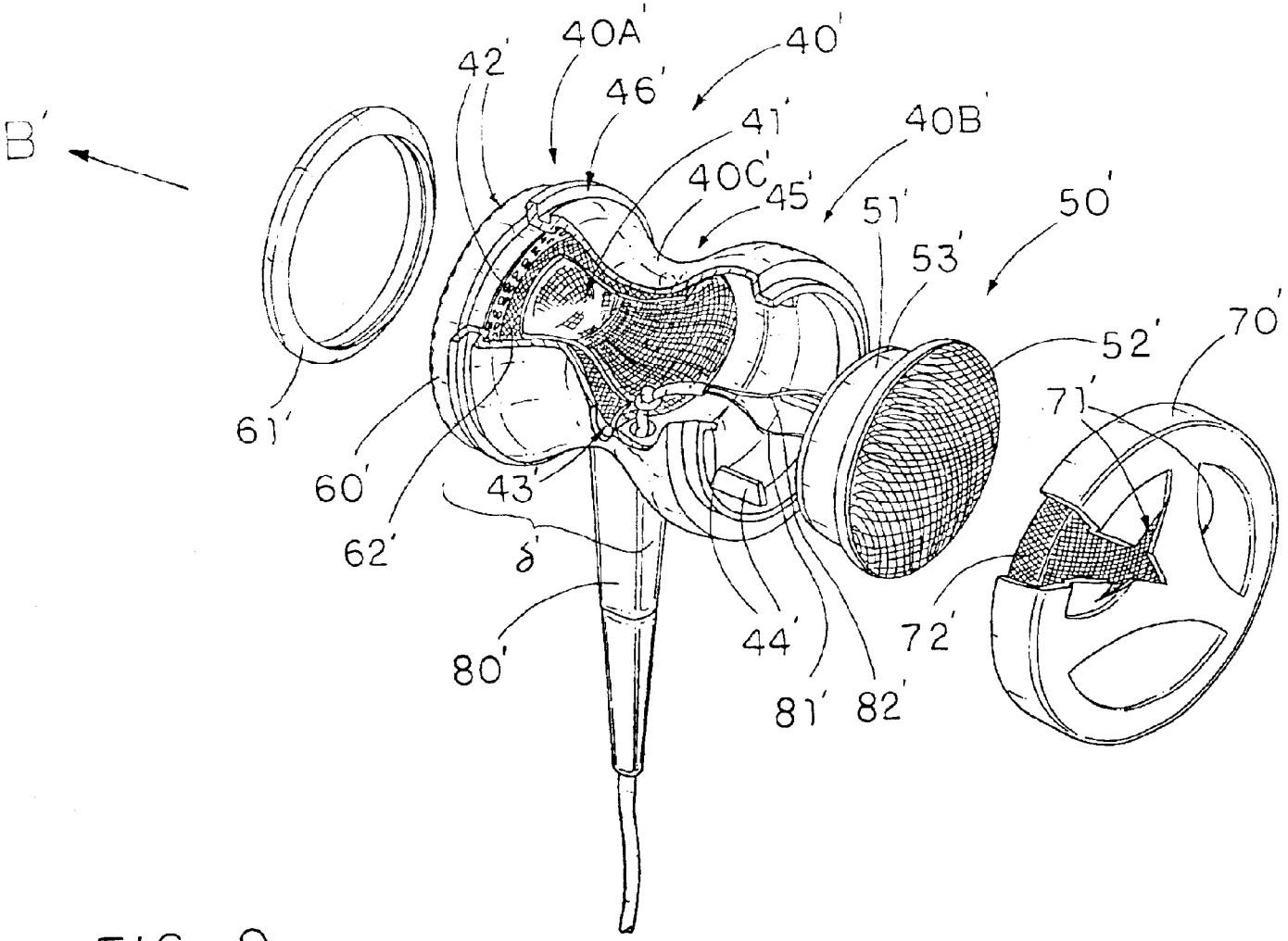
FIG. 9 is a partially sectioned and exploded perspective view of the earphone-speaker according to the above second alternative mode of the above preferred embodiment of the present invention.

Referring to FIGS. 7 to 9, a second alternative mode of the earplug type earphone speaker according to the above preferred embodiment of the present invention is illustrated, which comprises an earphone housing 40', which is a tubular hollow body having a front end 40A' and a rear end 40B' and a loudspeaker 50' coaxially mounted in the earphone housing 40', a front cover 60' covering the front end 40A' of the earphone housing 40', and a rear cover 70' covering the rear end 40B' of the earphone housing 40', wherein a plurality of sound outlet meshes 42' is provided on the front cover 60'.

According to the present invention, the loudspeaker 50' is mounted near to the rear end 40B' and the rear cover 70' and thus a predetermined distance δ is formed between the front cover 60' and the loudspeaker 50' so as to defined a sound chamber 41' between the sound outlet meshes 42' on the front cover 60' and the loudspeaker 50' inside the earphone housing 40'.

The loudspeaker 50' has an output end 52', i.e. the end where the speaker cone of the loudspeaker 50' facing to, and a back end 51', i.e. the end where the base magnet of the loudspeaker 50' facing to and the speaker cords connected thereto. Generally speaking, sound is generated due to the vibration of the speaker cone conducted by the electromagnetic field. Therefore, the output end 52' is an original impulse noise output end and the rear end 51' is a lower impulse noise output end with respect to the output end 52'.

According to the present invention, as shown in FIG. 9, a plurality of supporting ribs 44' are radially and spacedly protruded from the inner surface of the rear end 40B' of the earphone housing 40'. The loudspeaker 50' is inserted from the rear end 40B' and fittingly mounted near the rear end 40B' of the earphone housing 40' in such a manner that the rear end 51 ' which substantially has a smaller diameter than the output end 52' is sat and supported between the supporting ribs 44' while the output end 52' is rested against supporting ribs 44'. In other words, the output end 52', i.e. the original impulse noise output end, is arranged to face the rear cover 70' and the rear end 51', i.e. the lower impulse noise output end, is designed to face to the front end 40A' and the front cover 60'. Moreover, the earphone housing 40' further comprises a cord extension 45' downwardly and integrally projected from a middle portion of the earphone housing 40' wherein a pair of speaker cords 81, 82 are extended through the cord extension 45' into the sound chamber 41' and directly connected to the circuit board 53' attached to the rear end 51' of the loudspeaker 50'. The reason of why the loudspeaker 50' is intentionally mounted in such a reverse way will be explained after the full disclosure of the earplug type earphone of the present invention.

The rear cover 70' which is sealedly secured to the rear end 40B' of the earphone housing 40' has at least an impulse hole 71' provided thereon to release the impulse pressure of the sound generated from the output end 52' of the loudspeaker 50'.

The earphone housing 40' further has a plurality of sound inlet meshes 43' provided thereon and encircled the earphone housing 40' at a position between the front end 40A' and the loudspeaker 50' so as to communicate the sound chamber 41' with outside. According to this alternative mode of the preferred embodiment of the present invention, as shown in FIGS. 6 to 9, a middle portion of the earphone housing 40' reduces its diameter from the front end 40A' to form a narrowed neck portion 40C' and define a sound groove 45' encircling such neck portion 40C'. In other words, the sound inlet meshes 43' are positioned right on the neck portion 40C'.

As shown in FIG. 9, the earphone of the present invention further comprises a front sound filter 62' and a rear sound filter 72' each of which is made of mesh material and has a U-shaped cross section. The front sound filter 62' has a filter end inserted into the sound chamber 41' until reaching an inner surface of the front cover 60' and covering the sound outlet meshes 42' thereon and an opened end rearwardly extended around the inner wall surface of the earphone housing 40' until covering the sound inlet meshes 43'. The rear sound filter 72' is attached to an inner surface of the rear cover 70' so as to cover the output end 51 ' of the loudspeaker 50'.

The earphone of the present invention further comprises a rubber made wear ring 61' to be mounted on a ring groove 46' provided around the front end 40A' of the earphone housing 40' so as to facilitate the user to hanged on his or her ear A and provided a frictional contact with a tragus A1 and an antitragus A2 of the user's ear A for firmly mounting the earphone in position, as shown in FIG. 8.

Referring to FIGS. 8 and 9, the front end 40A' of the earphone is hanged fittedly between the tragus A1 and the antitragus A2 of the human ear A, wherein the front cover 60' and its sound outlet meshes 42' are facing to the ear canal B. Since the neck portion 40C' is smaller than the front end 40A', the sound inlet meshes 43' provided on the neck portion 40C' are exposed outside to collect any sound waves behind the front end 40A. When the earphone is used to listen music, music is generated at both ends, i.e. the output end 52' and the back end 51' of the loudspeaker 50'. However, the original impulse noise output from the output end 52' is emitted towards the rear end 40B' and outside through the impulse hole 71' of the rear cover 70'. At the same time, music with lower impulse noise is emitted from the back end 51' into the sound chamber 41' and transmitted towards the front end 40A, and then passes through the sound outlet meshes 42' provided on the front cover 60' to enter the ear canal B'. Moreover, the music emitted through the rear cover 70' and the sound from outside also enter the sound chamber 41' through the sound inlet meshes 43', wherein the sound chamber 41' substantially acts as a sound reservoir for combining the sound waves from the back end 51', the output end 52' and outside before entering into the ear canal B that can further provide a sound wave pressure releasing purpose. Also, the sound groove 45' can ensure the sound inlet meshes 43' won't be covered by the inlet end of the ear canal B'.

Accordingly, like the preferred embodiment as disclosed above, the user of the earphone can not only listen to the music produced by the loudspeaker 50' but also realize the events outside on the alert. Moreover, since the lower impulse noise output end 51', with respect to the output end 52' of the loudspeaker 50', is faced to the sound outlet meshes 42' at the front end 40A' of the loudspeaker 50', the sound, which combined with the surroundings and the loudspeaker 50', transmitted to the external auditory canal B' do not contain high impulse noise.

In view of above, the earplug type earphone of the present invention substantially achieves the advantages as follows:

(a) Prevent hearing discomfort and protects the user's ears from being injured. By having the loudspeaker to be installed with the output end facing outwards, i.e. the rear end of the earphone housing, the higher sound pressure waves run opposite to our ear canal while the "Reverse Sound" is permitted to enter the ear canal. Thus, the high sound pressure waves can be avoided to impact directly on our eardrums so as to eliminate the painful and itchy sensation on our eardrums where the symptoms of middle ear injury that traditional earphones may cause.

(b) Provide an amazing surround effect without extra electronic devices needed. The phases of the higher sound pressure and the lower sound pressure are 180 degrees in difference when they leave the speaker. As sounds at different frequencies have different paths, the phases are then different from each other at any point in space. The sound chamber within the earphone housing is designed to adjust the interfrence effect of sound waves. So that thousands of different phases of sound in relation to each frequency can be obtained. That's the virtual surround and spatial effect, which traditionally can only be achieved by using complicated time delay circuits and signal processors.

(c) Allow to hear sounds from an exterior environment thus ensure convenience and safety. Reverse sound is an open design. There are openings provided between the loudspeaker and the wearing part, i.e. the front end of the earphone housing. Thereby, it allows the user to hear sounds outside in order to prevent the danger of being audioly isolated. This is also very important when we wear the one-ear type hands-free system of a mobile phone. Because a human is able to identify the direction of sound only when both ears can hear sounds simultaneously. This is very imperative when walking or driving on the road with a hands-free cellular phone.

(d) Increase the sound clarity and thus enable the user to hear sound much more clearly without extra electronic devices needed. As mentioned, the phases of the higher sound pressure is opposite to the lower sound pressure side by 180 degrees when they leave the speaker. They will offset each other when they are mixed. Also, when the phase difference is 0 or 360 degrees, they will add to and enhance each other. The next important factor correlated to the sound clarity in communication is the response level at around 3000 Hz frequency. In order to get a good frequency response around 3000 Hz, what we do is to adjust the structure and make the journey difference of the two sound waves at the frequency 3000 Hz to be just half of the wave length of 3000 Hz. Then the phase difference of the two sound waves turn to be 0 degree. The two sound waves will add up and enhance the response level at frequency 3000 Hz, therefore increase the sound clarity without electronic devices.

(e) Provide a noise reduction effect without extra electronic devices.

(1) Higher Frequency Noise Reduction:

(i) The higher frequency sound is more directional. Because the direction of the speaker is installed to face opposite to the ear canal, the user will receive less higher frequency sounds than middle and lower ones.

(ii) The phases of the higher sound pressure are opposite to that of the lower sound pressure side by 180 degrees when they leave the speaker. The special structure of the earphone induces and mixes these two sounds. When the phase difference of these two sounds is at 180 degrees, they will offset each other. This is the very popular concept now called 'Active Noise Canceling'. We achieve it by a simple natural construction instead of using complicated electronic circuits.

(2) Lower frequency Noise Reduction:

(i) The lower frequency noise has less penetration potential and is much easier to be blocked. Lower sound pressure coming toward our ear canal becomes much less after passing through the loudspeaker's metal frame and leaking out from the small openings of the plastic ear housing.

(ii) As mentioned, the phases of the higher sound pressure are opposite to the lower sound pressure side by 180 degrees when they leave the loudspeaker. Because the wave length of the lower frequency sound is much larger than the difference of the paths of the high and low sound waves, their phase difference is still almost 180 degrees. They will then offset each other and cancel the lower frequency noise without complicated electronic devices.

(f) Provide the best wearing comfort by different earbud size design. Human ears differ a lot in size and shape. Since the loudspeaker is installed having a distance δ away from the front end and front cover, i.e. the earbud, that substantially hanged between the tragus and the antitragus of the user's ear, there can be lots of different designs of the earbud in size and shape to fit the ear without being restricted by the size or shape of the speaker.

What is claimed is:

1. An earplug type earphone speaker for plugging in a human ear, comprising:

an earphone housing having a front end having a front cover and a rear end which is adapted for hanging fittingly between a tragus and an antiragus of said human ear, wherein a plurality of sound outlet meshes is provided on said front cover and a plurality of supporting ribs are radially and spacedly protruded from an inner surface of said rear end of said earphone housing;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs; and speaker cords which are extended into said sound chamber and connected to said back end of said loudspeaker.

2. An earplug type earphone speaker for plugging in a human ear, comprising:

an earphone housing having a front end having a front cover and a rear end which is adapted for hanging fittingly between a tragus and an antiragus of said human ear, wherein a plurality of sound outlet meshes is provided on said front cover and a plurality of supporting ribs are radially and spacedly protruded from an inner surface of said rear end of said earphone housing, wherein a middle portion of said earphone housing reduces a diameter thereof from said front end to form a narrowed neck portion and define a sound groove encircling said neck portion, wherein said sound inlet meshes are positioned on said neck portion;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs; and speaker cords which are extended into said sound chamber and connected to said back end of said loudspeaker.

3. An earplug type earphone speaker for plugging in a human ear, comprising:

an earphone housing having a front end and a rear end which is adapted for hanging fittingly between a tragus and an antiragus of said human ear, wherein a plurality of sound outlet meshes is provided at said front end and a plurality of supporting ribs are radially and spacedly protruded from an inner surface of said rear end of said earphone housing, wherein a middle portion of said earphone housing reduces a diameter thereof from said front end to form a narrowed neck portion and define a sound groove encircling said neck portion, wherein said sound inlet meshes are positioned on said neck portion;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs;

a front cover covering said front end of said earphone housing and said sound outlet meshes are provided on said front cover; and speaker cords which are extended into said sound chamber and connected to said back end of said loudspeaker.

4. An earplug type earphone speaker for plugging in a human ear, comprising:

an earphone housing having a front end and a rear end which is adapted for hanging fittingly between a tragus and an antiragus of said human ear, wherein a plurality of sound outlet meshes is provided at said front end and a plurality of supporting ribs are radially and spacedly protruded from an inner surface of said rear end of said earphone housing, wherein a middle portion of said earphone housing reduces a diameter thereof from said front end to form a narrowed neck portion and define a sound groove encircling said neck portion, wherein said sound inlet meshes are positioned on said neck portion;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs;

a front cover covering said front end of said earphone housing and said sound outlet meshes are provided on said front cover;

a rear cover covering said rear end of said earphone housing, wherein at least an impulse hole is formed on said rear cover; and speaker cords which are extended into said sound chamber and connected to said back end of said loudspeaker.

5. An earplug type earphone speaker for plugging in a human ear, comprising:

an earphone housing having a front end and a rear end which is adapted for hanging fittingly between a tragus and an antiragus of said human ear, wherein a plurality of sound outlet meshes is provided at said front end and a plurality of supporting ribs are radially and spacedly protruded from an inner surface of said rear end of said earphone housing;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs; and a front cover covering said front end of said earphone housing and said sound outlet meshes are provided on said front cover;

a front sound filter, which is made of mesh material, having a filter end inserted into said sound chamber until reaching an inner surface of said front cover and covering said sound outlet meshes thereon and an opened end rearwardly extended around said inner wall surface of said earphone housing until covering said sound inlet meshes; and speaker cords which are extended into said sound chamber and connected to said back end of said loudspeaker.

6. An earplug type earphone speaker for plugging in a human ear, comprising:

an earphone housing having a front end and a rear end which is adapted for hanging fittingly between a tragus and an antiragus of said human ear, wherein a plurality of sound outlet meshes is provided at said front end and a plurality of supporting ribs are radially and spacedly protruded from an inner surface of said rear end of said earphone housing, wherein a middle portion of said earphone housing reduces a diameter thereof from said front end to form a narrowed neck portion and define a sound groove encircling said neck portion, wherein said sound inlet meshes are positioned on said neck portion;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs; and a front cover covering said front end of said earphone housing and said sound outlet meshes are provided on said front cover;

a front sound filter, which is made of mesh material, having a filter end inserted into said sound chamber until reaching an inner surface of said front cover and covering said sound outlet meshes thereon and an opened end rearwardly extended around said inner wall surface of said earphone housing until covering said sound inlet meshes; and speaker cords which are extended into said sound chamber and connected to said back end of said loudspeaker.

7. An earplug type earphone speaker for plugging in a human ear, comprising:

an earphone housing having a front end and a rear end which is adapted for hanging fittingly between a tragus and an antiragus of said human ear, wherein a plurality of sound outlet meshes is provided at said front end;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside;

a front cover covering said front end of said earphone housing and said sound outlet meshes are provided on said front cover;

a rear cover covering said rear end of said earphone housing, wherein at least an impulse hole is formed on said rear cover;

a front sound filter and a rear sound filter each of which is made of mesh material, wherein said front sound filter has a filter end inserted into said sound chamber until reaching an inner surface of said front cover and covering said sound outlet meshes thereon and an opened end rearwardly extended around said inner wall surface of said earphone housing until covering said sound inlet meshes, wherein said rear sound filter is attached to an inner surface of said rear cover so as to cover said output end of said loudspeaker; and speaker cords which are extended into said sound chamber and connected to said back end of said loudspeaker.

8. An earplug type earphone speaker for plugging in a human ear, comprising:

an earphone housing having a front end and a rear end which is adapted for hanging fittingly between a tragus and an antiragus of said human ear, wherein a plurality of sound outlet meshes is provided at said front end and a plurality of supporting ribs are radially and spacedly protruded from an inner surface of said rear end of said earphone housing, wherein a middle portion of said earphone housing reduces a diameter thereof from said front end to form a narrowed neck portion and define a sound groove encircling said neck portion, wherein said sound inlet meshes are positioned on said neck portion;

a loudspeaker coaxially mounted in said earphone housing wherein a predetermined distance is formed between said front end and said loudspeaker and a sound chamber is defined between said sound outlet meshes and said loudspeaker inside said earphone housing, wherein said loudspeaker has an output end which is an original impulse noise output end and a back end which is a lower impulse noise output end with respect to said output end, wherein said output end is installed to face said rear end of said earphone housing and said back end is installed to face said sound chamber and said front end of said earphone housing, wherein a plurality of sound inlet meshes is provided on and encircled said earphone housing at a position between said front end and said back end of said loudspeaker so as to communicate said sound chamber with outside, wherein said loudspeaker is inserted from said rear end and fittingly mounted near said rear end of said earphone housing in such a manner that said rear end, which substantially has a smaller diameter than said output end, is sat and supported between said supporting ribs while said output end is rested against said supporting ribs;

a front cover covering said front end of said earphone housing and said sound outlet meshes are provided on said front cover; and a rear cover covering said rear end of said earphone housing, wherein at least an impulse hole is formed on said rear cover;

a front sound filter and a rear sound filter each of which is made of mesh material, wherein said front sound filter has a filter end inserted into said sound chamber until reaching an inner surface of said front cover and covering said sound outlet meshes thereon and an opened end rearwardly extended around said inner wall surface of said earphone housing until covering said sound inlet meshes, wherein said rear sound filter is attached to an inner surface of said rear cover so as to cover said output end of said loudspeaker; and speaker cords which are extended into said sound chamber and connected to said back end of said loudspeaker.

9. The earplug type earphone, as recited in claim 8, wherein said front end of said earphone housing further has a ring groove provided therearound and said earphone further comprises a wear ring which made of elastic material mounted on said ring groove of said earphone housing.

* * * * *